US006871612B2

(12) United States Patent
Gursoy

(10) Patent No.: US 6,871,612 B2
(45) Date of Patent: Mar. 29, 2005

(54) PONTOON STABILIZED ALUMINUM WATER CRAFT

(76) Inventor: Erkan Gursoy, 145 Prideaux Street, Nanaimo, British Columbia (CA), V9R 2M8

( * ) Notice: Subject to any disclaimer, the term of this patent is extended or adjusted under 35 U.S.C. 154(b) by 0 days.

(21) Appl. No.: 10/751,422

(22) Filed: Jan. 6, 2004

(65) Prior Publication Data

US 2004/0134407 A1 Jul. 15, 2004

Related U.S. Application Data

(60) Provisional application No. 60/438,086, filed on Jan. 6, 2003.

(51) Int. Cl.[7] ..... B63B 3/00
(52) U.S. Cl. ..... 114/356; 114/123
(58) Field of Search ..... 114/356, 123

(56) References Cited

U.S. PATENT DOCUMENTS 3,388,446 A * 6/1968 Phillips ..... 29/897.2
5,870,965 A * 2/1999 Hansen ..... 114/283

* cited by examiner

*Primary Examiner*—Jesus D. Sotelo
(74) *Attorney, Agent, or Firm*—J. Gordon Thomson

(57) ABSTRACT

The invention is an improved aluminum water craft using a plurality of aluminum pontoons to stabilize the craft. The hull of the craft has a truncated "U" shape with a first horizontal section and a second raised bow section. The hull is made from a single piece of construction material and includes a plurality of equally spaced apart concave-shaped reinforcing ribs pressed into the top surface of the construction sheets prior to forming the hull. The ribs provide additional rigidity and strength to the hull. The plurality of pontoons join to form a segmented, un-pressurized, water-tight, air filled floatation collar around the hull of the water craft. The pontoon segments are separated by bulkhead plates. The pontoons are inclined from the horizontal to promote smooth travel over turbulent water. The pontoons are constructed from single sheets of construction material. A plurality equally spaced and parallel reinforcing ribs pressed into the rectangular sheets. The sheets are then rolled into the cylindrical shaped pontoons and welded.

16 Claims, 16 Drawing Sheets

80
78
14
76
DETAIL C
DETAIL B
17
19
12
60
55
19
Floor
1/8" Aluminum
tread plate
60
60
19
17
60°
60°
60°
60°

PONTOON STABILIZED ALUMINUM WATER CRAFT

CROSS-REFERENCE TO RELATED APPLICATIONS

This non-provisional patent application claims the benefit of U.S. Provisional Patent Application 60/438,086 filed on Jan. 6, 2003.

BACKGROUND OF THE INVENTION

1. Field of the Invention

This invention relates to water craft. This invention further relates to an improved pontoon stabilized aluminum water craft.

2. Background of the Invention

Small water craft are commonly used for recreational and business purposes in rivers and lakes. Pontoon stabilized boats are also common. Typically, these water craft comprise a hull placed between buoyant pontoons. The pontoons are generally inflatable cylindrical members. The pontoons provide buoyancy and stability to the water craft permitting larger loads and travel at higher speeds across turbulent water. There are a number of disadvantages associated with known water craft using inflatable pontoons. These disadvantages can be summarized as:

- They require inflation and inflation pressure requires constant monitoring.
- Pressurized pontoons are prone to air leakage.
- Inflation valves can be damaged and can leak resulting in deflation during operation.
- They require additional internal and or external stiffening members to reduce inherent flexibility.
- They are prone to damage, particularly punctures, when operating on bodies of water that may have floating or hidden flotsam, such as dead-headed logs, or submerged rocks in moving water.
- Accessories such as oar locks, fenders, rubbing strakes, and D-rings have to be stitched or glued to the pontoon fabric and therefore can be easily dislodged or damaged.
- The pressurized pontoons require constant maintenance.
- The material from which inflatable pontoons is made is subject to degradation from UV radiation.

Mixed hull rigid inflatable boats attempt to overcome some of these deficiencies by providing for a metallic submerged hull between inflatable pontoons. However, they still do not resolve the problems related to inflatable pontoons.

There are also all aluminum boats using pontoons, but these craft tend to be very heavy due to the thickness of the aluminum used.

Therefore, it is desirable to have a strong and light-weight small water craft having the stability and buoyancy of pontoons without the disadvantages associated with inflatable pontoons.

OBJECTIVES OF THE INVENTION

It is an object of the present invention to provide an improved aluminum pontoon stabilized water craft that overcomes the deficiencies associated with previously known pontoon stabilized water craft.

It is another objective of the present invention to provide an improved pontoon stabilized water craft that is made of a light weight, maintenance free and strong aluminum construction material.

It is yet another object of the present invention to provide an improved pontoon stabilized water craft having integral reinforcing members that are pressed into both the hull portion and pontoon members of the water craft along their respective longitudinal axis to provide enhanced stiffness and strength to the overall structure and permit a reduction of weight of the overall structure.

SUMMARY OF THE INVENTION

In order to overcome the deficiencies noted above and to meet the objectives stated herein, my invention provides for a pontoon stabilized aluminum water craft comprising a truncated "U" shaped hull portion having a longitudinal axis, a top surface, and a bottom surface. The aluminum hull portion comprises a first horizontal section having a first port side, a first starboard side and a stern. There is also a second bow section contiguous to the first horizontal section. The second bow section has a first positive acclivity of about 36 degrees from the horizontal. The second bow section also has a second port side, a second starboard side and a truncated bow. The hull portion has a plurality of parallel and equally spaced apart concave-shaped reinforcing ribs pressed by pressing means into the top surface of the hull portion. A keel member is fixed to the bottom surface of the hull portion along the longitudinal axis. There is also included a plurality of aluminum cylindrical pontoon members fixed to the hull portion. The cylindrical pontoon members have an outside surface and an inside surface and are adapted to provide buoyancy and stability to the water craft.

Fixing means comprises any welding process suitable for welding aluminum.

The plurality of cylindrical pontoon members comprises a first port side pontoon member having a stern end and a bow end. The first port side pontoon member is fixed to the first port side of the hull portion first horizontal section. There is also a first starboard side pontoon member having a stern end and a bow end. The first starboard side pontoon member is fixed to the first starboard side of the hull portion first horizontal section. There is also a second port side pontoon member having a stern end and a bow end. The second port side pontoon member is fixed to the second port side of the second bow section. Between the first and second port side pontoon members there is a welded bulkhead plate to provide a water and air tight seal between them. There is further a second starboard pontoon member having a stern end and a bow end fixed to the second starboard side of the second bow section. Between the first and second starboard side pontoon members there is a welded bulkhead plate to provide a water and air tight seal between them. The bow pontoon member has a port end and a starboard end. The bow pontoon member is oriented perpendicular to the longitudinal axis of the hull portion. The second port side pontoon member stern end is fixed to the first port side pontoon member bow end and the second starboard side pontoon member stern end is fixed to the first starboard side pontoon member bow end. The port end of the bow pontoon member is fixed to the bow end of the second port side pontoon member and the starboard end of the bow pontoon member is fixed to the bow end of the second starboard side pontoon member. On either side of the bow pontoon member is welded a bulkhead plate to provide a water and air tight seal between the bow pontoon member and the adjacent port and starboard second pontoon members.

The stern end of the first starboard side pontoon member is sealed by a domed cap bulkhead plate and the stern end of the first port side pontoon member is sealed by a domed cap bulkhead plate to provide a water and air tight seal. The plurality of pontoon members are joined during the construction of the water craft to form a segmented, un-pressurized, water-tight, air tight and air filled floatation collar around the bow, port side and starboard side of the hull portion of the water craft thereby providing for enhanced buoyancy and stability to the water craft.

There is also a transom member fixed to the stern of the hull portion to close the stern end of the hull portion. The transom is disposed proximate to the stern ends of the first port side pontoon member and the first starboard side pontoon member.

There are at least two flat members are disposed between the first port side and first starboard side of the first horizontal section of the hull portion for use as seats for operators and passengers. There may also be an aluminum cockpit shelter fixed to the hull. Fixed by fixing means to the floor of the hull is a tread plate.

The port side first pontoon member has a first longitudinal axis and the starboard side first pontoon member has a second parallel and co-planer longitudinal axis. These axis posses a second positive acclivity of about 5 degrees so that the first port side pontoon member and the first starboard side pontoon member are slightly inclined from their respective stern ends to their respective bow ends.

The second port side pontoon member has a third longitudinal axis and the second starboard side pontoon member has a fourth longitudinal axis parallel to and co-planer with the third longitudinal axis. The third and fourth axis have a third positively acclivity of about 20 to 25 degrees. This is somewhat greater than the second positive acclivity but less than the first positive acclivity so that the bow member of the water craft does not obscure the forward vision of the water craft operator. As well, the first and second acclivities promote the smooth progression of the water craft through smooth and turbulent water.

A fender fixed to the outside surface of the plurality of cylindrical pontoon members. The fender is fabricated from a suitable resilient, shock absorbing and UV radiation resistant material.

The cylindrical pontoon members are fabricated from rectangular sheets of aluminum. The sheets are rolled by rolling means to form the plurality of cylindrical pontoon members. The pontoon members are welded along their end joints. A plurality of reinforcing structural features is pressed into the sheets by pressing means.

Further objects and advantages will become apparent from a consideration of the ensuing description and drawings.

DETAILED DESCRIPTION OF THE INVENTION

Figure 1:
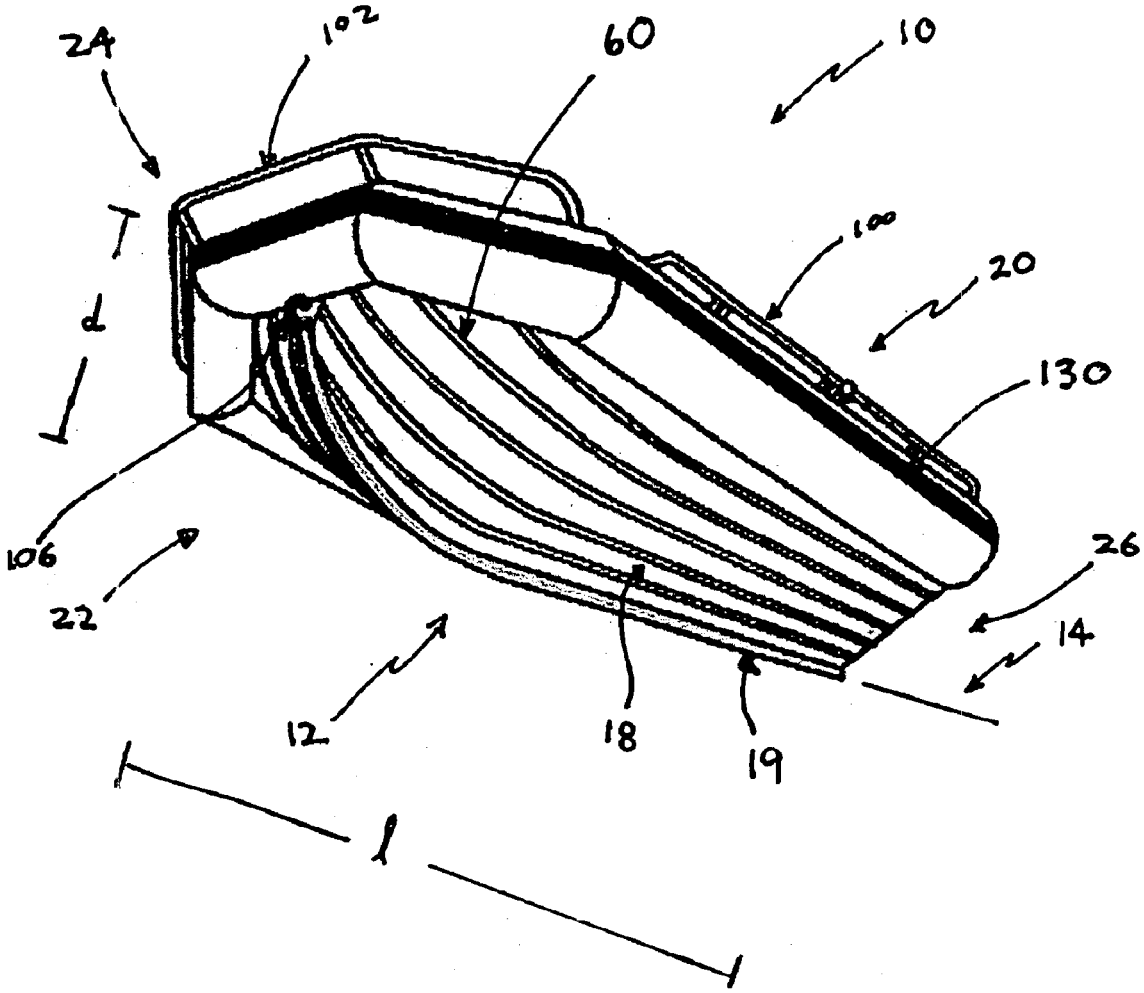
FIG. 1 is perspective bottom view of a preferred embodiment of the water craft of my invention.
Figure 2:
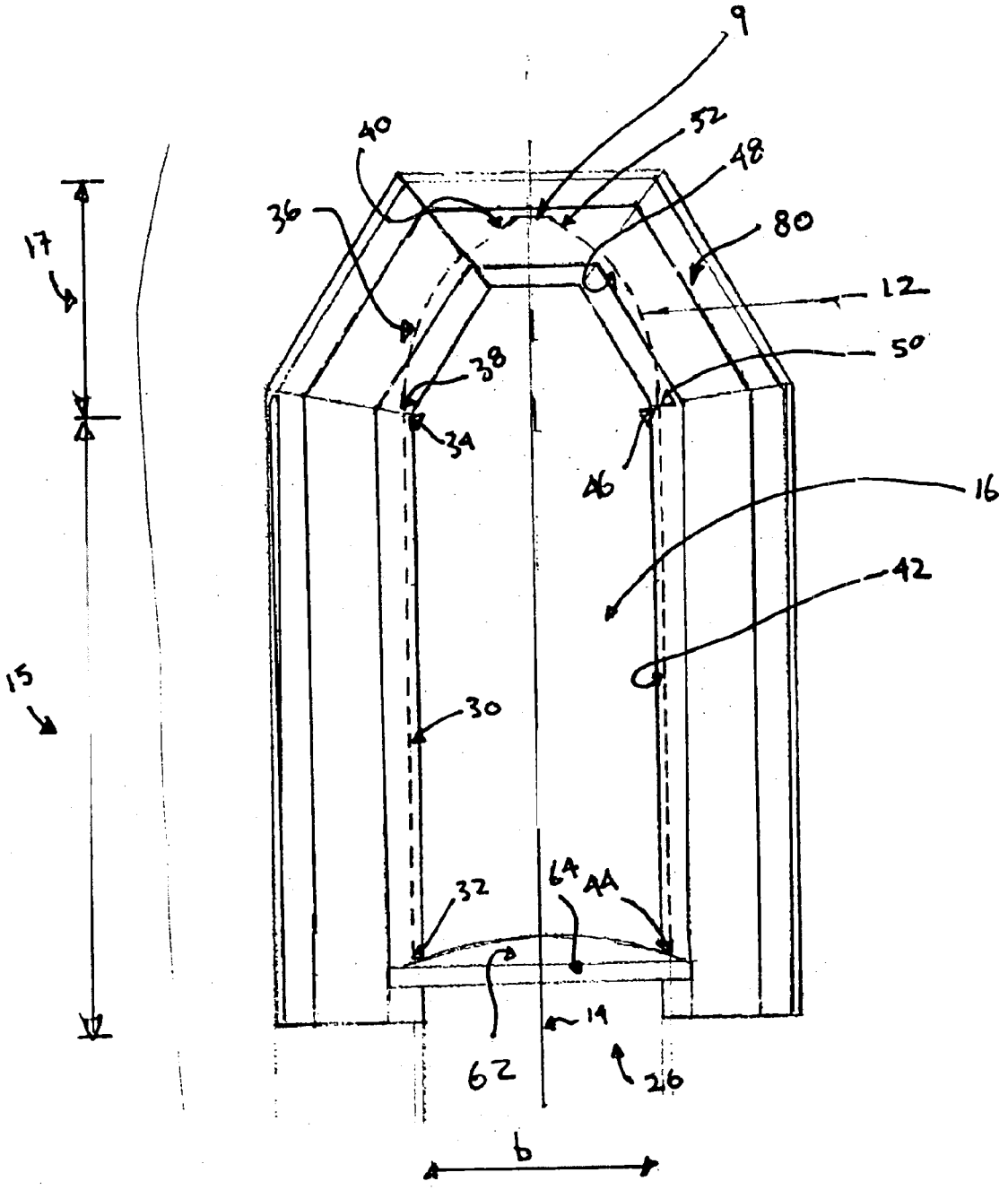
FIG. 2 is a plan view of the one embodiment of the water craft of my invention showing in dotted line configuration the outline of the truncated "U" shaped hull portion.

Referring to FIG. 1 and to FIG. 2, there is shown a perspective bottom view my invention (10), namely, a pontoon stabilized aluminum water craft manufactured from a light weight and strong aluminum alloy. The water craft comprises a hull portion (12) having a bow (24), a stern (26), a longitudinal axis (14), a predetermined length (l), a predetermined depth (d) and a predetermined beam (b). The hull portion (12) has a port (20) and a starboard (22). These dimensions (l), (d) and (b) vary according to the specified size of the boat.

Referring to FIG. 1 and FIG. 2, the hull portion (12) has a truncated "U" shape, a top surface (16) and a bottom surface (18). The truncated portion (9) of the "U"-shaped hull portion (12) is about four inches wide.

Figure 3:
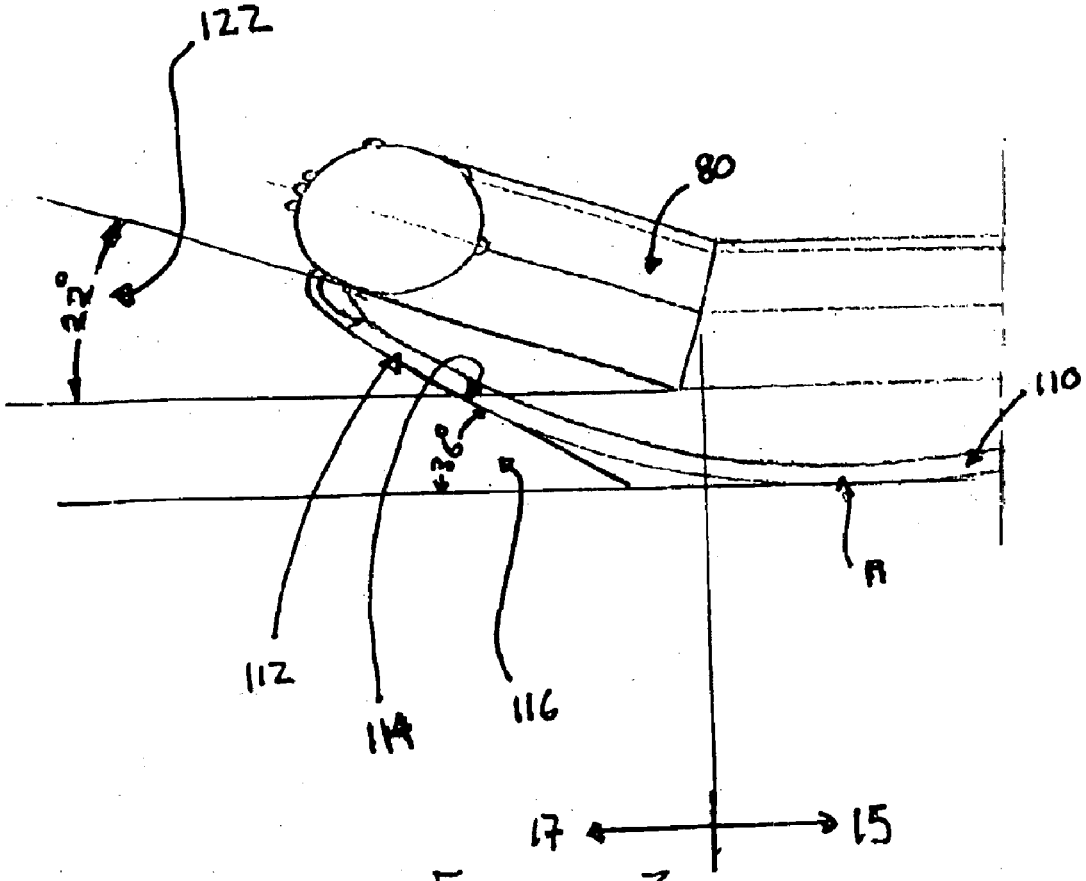
FIG. 3 is an elevation and sectional view of the inclined bow portion of one embodiment of my invention.

Referring to FIGS. 1, 2 and 3, the hull portion (12) includes a first horizontal section (15) and a second bow section (17). The keel (19) of the second bow section (17) has a first positively acclivity (116) of about 36 degrees between the horizontal and tangent line (114). The pontoon (80) of the bow portion has a second positive acclivity (122) of about 22 degrees from the horizontal.

Referring to FIG. 3, the inclined bow portion (17) and the horizontal portion (15) are contiguous. The hull portion is formed from the same single sheet of construction material for water craft lengths less than 14 feet long. For craft lengths over 14 feet and up to 25 feet long, the hull is fabricated from two pieces of construction material welded together along the keel (19). The description of the hull portion having a first horizontal section and a second inclined bow portion is to assist only in the illustration of my invention. There is no visible distinguishing transition point between the horizontal section of the hull portion and the inclined section of the hull portion.

Referring to FIG. 2, the hull portion (12) includes a first horizontal section (15) having a first port side (30) has a stern end (32) and a bow end (34) and is parallel to the longitudinal axis (14) of the hull portion (12). The first horizontal section (15) also has a first starboard side (42) having a stern end (44) and a bow end (46) that is also parallel to the longitudinal axis (14) of the hull portion (12). The second positively inclined bow section (17) includes a second port side (36) having a stern end (38) and a bow end (40). The second port side (36) is curved inwardly to the truncated portion (9) to provide for one-half of the truncated "U" shape of hull portion (12). The second positively inclined bow section (17) also has a second starboard side (48) having a stern end (50) and a bow end (52). The second starboard side is also curved inwardly to the truncated portion (9) of the hull (12) to provide for on-half of the truncated "U" shape of the hull portion (12). The bow end (9) of the hull portion (12) forms the blunt nosed truncated portion of the truncated "U" shape of the hull portion (12).

The first positive acclivity (116) to the bow section (17) permits a smooth and stable planning action across flat or choppy water at relatively high speeds. The positive acclivity (116) of the bow section (17) also provides for depth (d) to the inside surface of the hull portion (12) permitting stowage of cargo. Generally the hull portion (12) has lengths (l) ranging from 9 feet to 14 feet and beams (b) range from 4.5 feet to 6 feet. Larger lengths can be constructed.

Referring back to FIG. 1, the hull portion (12) further includes a keel member (19) that extends from the bow (24) of the outside surface (18) of the hull portion (12) to the stern (26). The keel member (19) is fixed by fixing means to the bottom of the hull portion (12) and provides for proper tracking and steerage of the water craft as it travels over water. Fixing means includes any suitable aluminum welding process. Generally, the keel member is an aluminum strip that is about 1.5 inches wide and 0.25 inches thick bent and welded to the bottom of the hull (12) along its longitudinal axis (14).

Referring to FIG. 3, the keel member (19) comprises a first horizontal section (110) along the bottom of the hull portion first horizontal section (15) and a second curving section (112) along the bottom of the second positively inclined bow section (17). The second curving section (112) conforms to the curve of the inclined bow section.

Referring to FIG. 1, the hull portion (12) further comprises a plurality of concave-shaped, equally spaced and parallel ribs (60) to provide strength to the light weight aluminum hull portion to avoid excessive flexure of the hull portion and potential permanent deformations in the hull portion. The plurality of ribs (60) is pressed by pressing means into the top surface (16) of hull portion (12) during manufacture as more fully explained below so that any given section of the hull will benefit from the reinforcing ribs. Due to the shape of the inclined bow portion (17) the ribs will appear to converge in that section towards the inclined section (110) of the keel member (19).

Pressing ribs (60) into the aluminum hull portion (12) permits the use of thinner construction material while increasing the strength of the water craft. Therefore there is an advantage to the invention in the form of weight savings and cost savings. This lends to affordability and portability of the water craft. The typical unloaded weight of the water craft of my invention ranges from about 130 pound to about 200 pounds. It is clear that such construction affords light weights that are comparable to similarly sized water craft using inflatable pontoons.

Referring now to FIG. 2, the stern (26) of the hull portion (12) of the water craft of my invention (10) is enclosed by a transom member (62). The transom member (62) is configured to the shape of the hull portion (12) at the stern and welded in place. The transom member (62) has a top surface (64) that is adapted for mounting a small outboard motor. The transom is made from two pieces of aluminum and is inclined into the craft at an angle of about 5 degrees from the vertical. Hand holds (106) may be welded to the transom.

Figure 4:
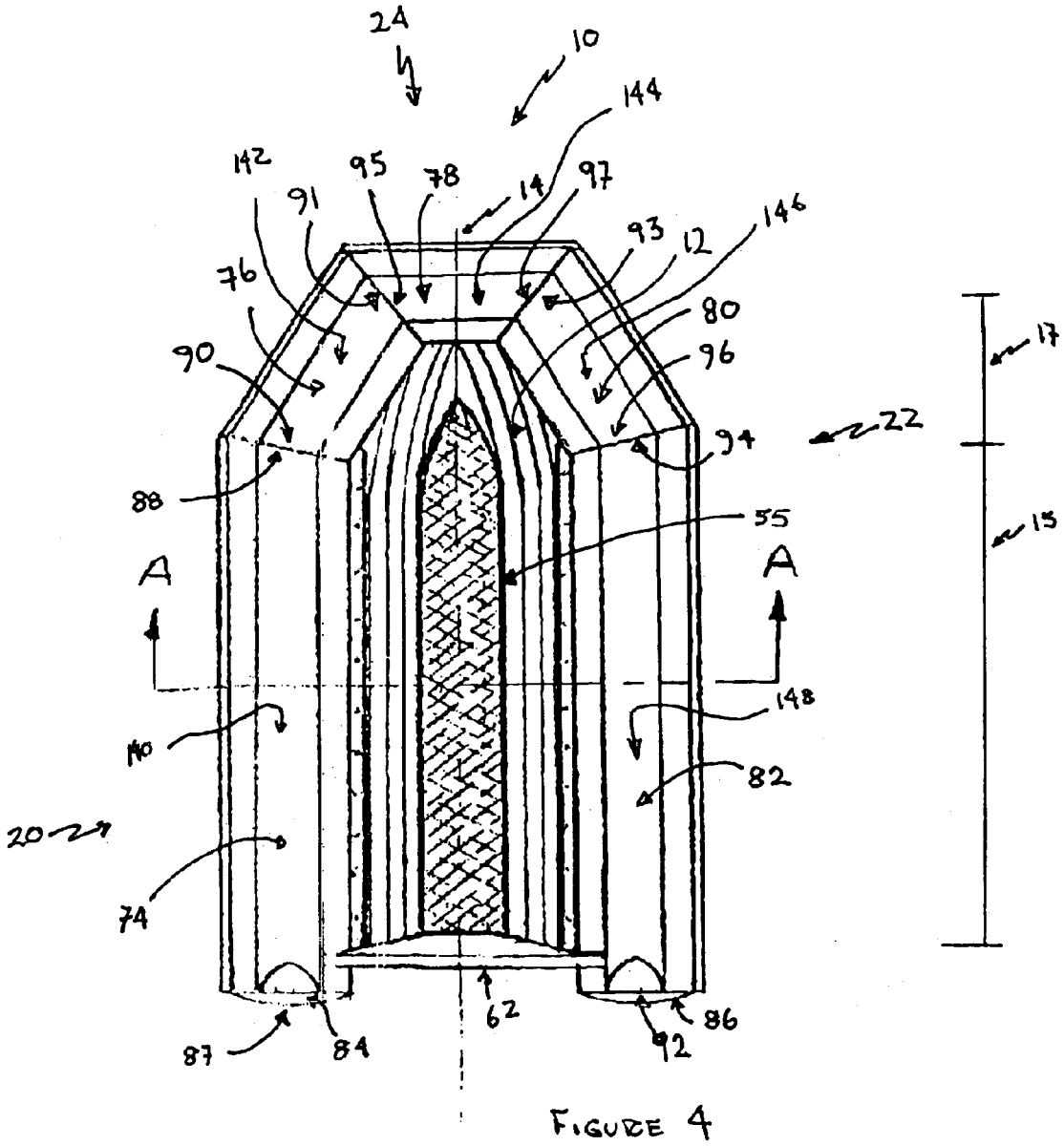
FIG. 4 is a plan top view of one embodiment of my invention with the seats not shown to better illustrate the hull portion.

Referring now to FIG. 2 and FIG. 4, there is fixed by fixing means to the hull portion (12) of my water craft (10) are a plurality of aluminum cylindrical pontoon members. The pontoon members are sealed, water tight, air-filled and air tight but not pressurized. Therefore there is no inherent motivation for air to leak out of the pontoons and there is no need for inflation valves and pressure monitors.

On the port side (20) of the water craft (10) there is a first port side pontoon member (74) that is fixed by fixing means to the first port side (30) of the horizontal section (15) of the hull portion (12). The first port side pontoon member (74) has a closed stern end (87) and a closed bow end (88). The stern end (87) is sealed by fixing means using a domed cap sealing plate (84). The bow end is closed by a bulkhead plate (89) not shown.

On the starboard side (22) there is a first starboard side pontoon member (82) that is fixed by fixing means to the starboard side (42) of the first horizontal section (15) of the hull portion (12). The first starboard side pontoon member has a closed stern end (92) and a closed bow end (94). The stern end (92) of the first starboard side pontoon member is sealed using a domed cap sealing plate (86). The bow end (94) is closed by a bulkhead plate (91) identical to plate (89).

On the port (20) side, there is a second port side pontoon member (76) fixed to port second side (36) of the inclined section (17) of hull portion (12). The second port pontoon member (76) has a stern end (90) and a bow end (91). Stern end (90) is open and fixed by fixing means to closed bow end (88) of the first port side pontoon member (74). The second port side pontoon member (76) is toed in and angled upwards at the same angles as the second port side (36) to which it is fixed.

On the starboard side (22) there is a second starboard side pontoon member (80) that is fixed to starboard second side (48). The second starboard side pontoon member (80) has an open stern end (96) and an open bow end (93). Open stern end (96) is fixed by fixing means to the closed bow end (94) of the first starboard side pontoon member. The second starboard side member (80) is toed in and angled upwards at the same angles as the second starboard side (48) to which it is fixed.

At the bow (24) there is a bow pontoon member (78) fixed to the truncated bow end (9) of the inclined bow section (17). The axis of the bow pontoon member (78) is perpendicular to the axis (14) of the hull portion (12). The bow pontoon member (78) has a closed port end (95) that is fixed by fixing means to the open bow end of second port pontoon member (76) and a closed starboard end (97) that is fixed by fixing means to the open bow end (93) of the second starboard pontoon member (80). Port end (95) and starboard end (97) are closed by welded bulkhead plates (101) and (103) respectively, not shown.

Once installed on the hull portion (12), pontoons (74), (76), (78), (80) and (82) form a segmented air filled floatation collar around the bow, port and starboard sides of the hull portion providing for enhanced buoyancy and stability of my water craft. A puncture in any one of the pontoon members will not seriously degrade the safety of the small water craft in operation. The plurality of pontoon members are welded together first and then the hull portion is fixed to the pontoon members.

Floor (55) is welded as a single piece of aluminum material to the inside surface (16) of the hull (12). The floor has an anti-slipping surface.

Figure 5:
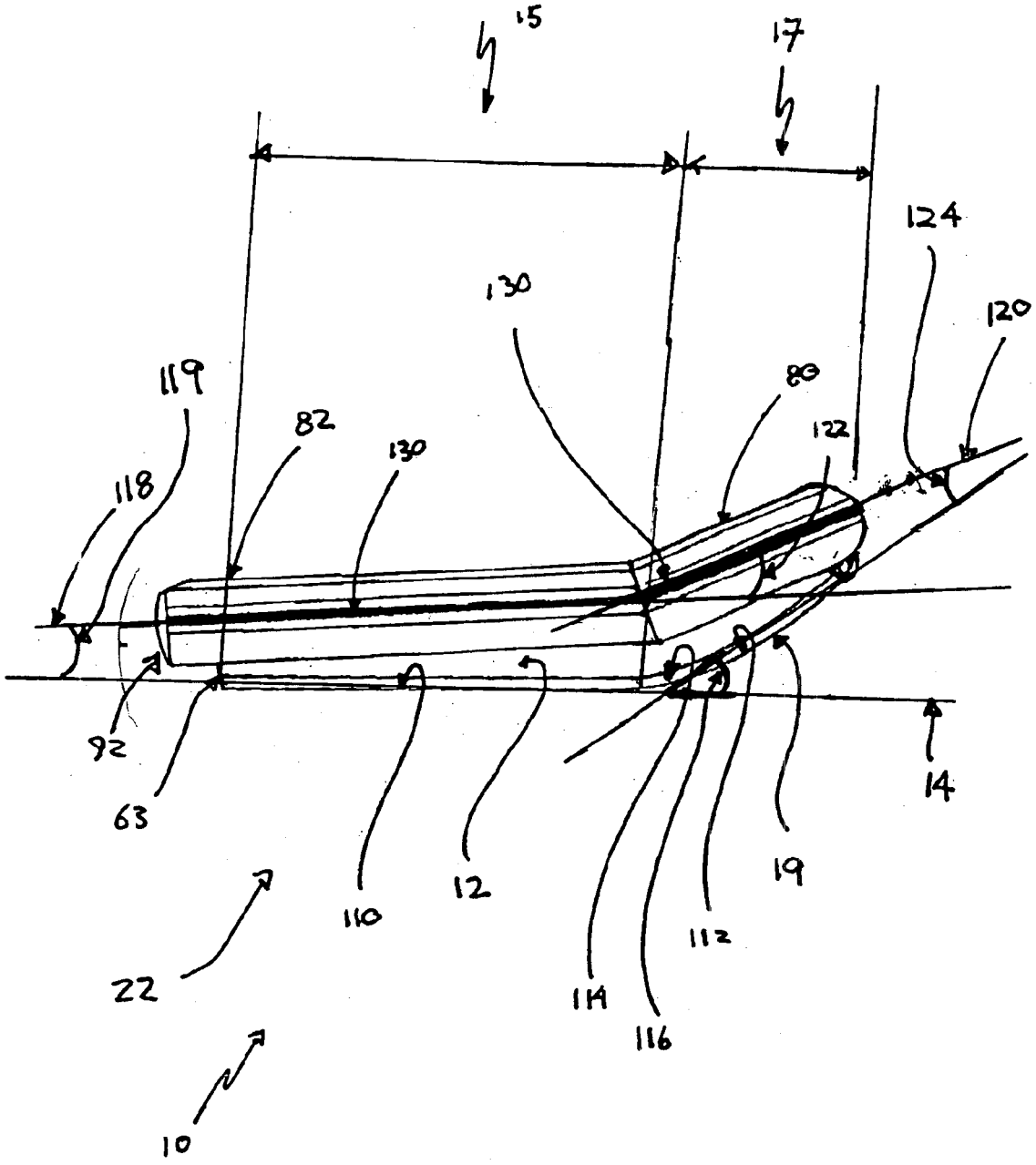
FIG. 5 is an elevation view of the starboard side of the water craft of my invention.

Referring now to FIG. 5, there is shown an elevation view of the starboard side (22) of the water craft (10). One of the features of my invention are the relative positive acclivities between the hull portion (12) and the plurality of pontoon members that provides for a stable high-speed planning action across open water whether smooth or choppy and prevents excessive water from being splashed into the water craft. FIG. 5 illustrates the hull portion (12) having a first horizontal section (15) and a second inclined bow section (17). Keel member (19) fixed along the axis (14) of the hull portion (12). The keel (19) has a horizontal first section (110) and a curved second section (112). First acclivity (116) is about 36 degrees and is formed between the horizontal first section of the keel and a tangent line (114) to the curved portion of the keel (112). This first acclivity in the keel member (19) raises the bow portion (17) so that when the water craft is traveling across open turbulent water, water is not permitted to splash over the bow and into the water craft. Spray caused by passage of the hull portion through open water is deflected away from the open hull by the pontoon members.

Also shown in FIG. 5 are starboard side first pontoon member (82) and starboard side second pontoon member (80). The starboard side first pontoon member (82) has an axis (118). As shown in FIG. 5, the axis (118) of the starboard side first pontoon member (82) has a slight positive second acclivity (119) of about 5 degrees from the horizontal represented by axis (14). This slight second positive acclivity (119) further promotes smooth planning action of the water craft across turbulent water. The incline of the starboard side first pontoon member and its opposite port side first pontoon member (which has an axis parallel and co-planer to axis (119)) act to permit the water craft to through turbulent water and helps to prevent water from splashing over the sides of the water craft.

The starboard second pontoon member (80) axis (120) has a third positive acclivity (122) of about 22 degrees with respect to the horizontal (14) and about 17 degrees with respect to the axis (118) of the starboard first pontoon member (82). The second positive acclivity (119) between the first horizontal section (110) of the keel (19) and the first pontoon member (82) and the third positive acclivity (122) between the axis (120) of the second pontoon member (80) and the axis (118) of the first pontoon member (82) promotes the smooth planning of the water craft across water. However, if the third positive acclivity (122) of the second pontoon member (80) is too large, the bow pontoon member (78) will obscure the vision of the operator who is most likely sitting at the stern of the water craft. To compensate for this, the third positive acclivity (122) of the starboard second pontoon member (80) with respect to the axis (118) is less than the first positive acclivity (116) of the inclined section (112) of the keel (19) with respect to the horizontal. The difference between the third acclivity (122) and first acclivity (116) can be shown by angle (124). The port side of the water craft is similarly configured as discussed above.

FIG. 5 also illustrates the fender (130) that is fixed to the outboard side of the starboard first pontoon member (82) and starboard second pontoon member (80). This fender (130) extends around the outside of the water craft and is adapted to absorb shock from docking the water craft. The fender is made from a suitable UV radiation resistant, resilient and shock absorbing material such as vinyl.

Referring back to FIG. 4, the top surfaces (140), (142), (144), (146) and (148) respectively of each of the pontoon members are suitable for seating along the sides of the pontoons if necessary. A plurality of hand hold devices, oar locks, D-rings, tow hooks and similar devices can be welded to these top surfaces.

Figure 6:
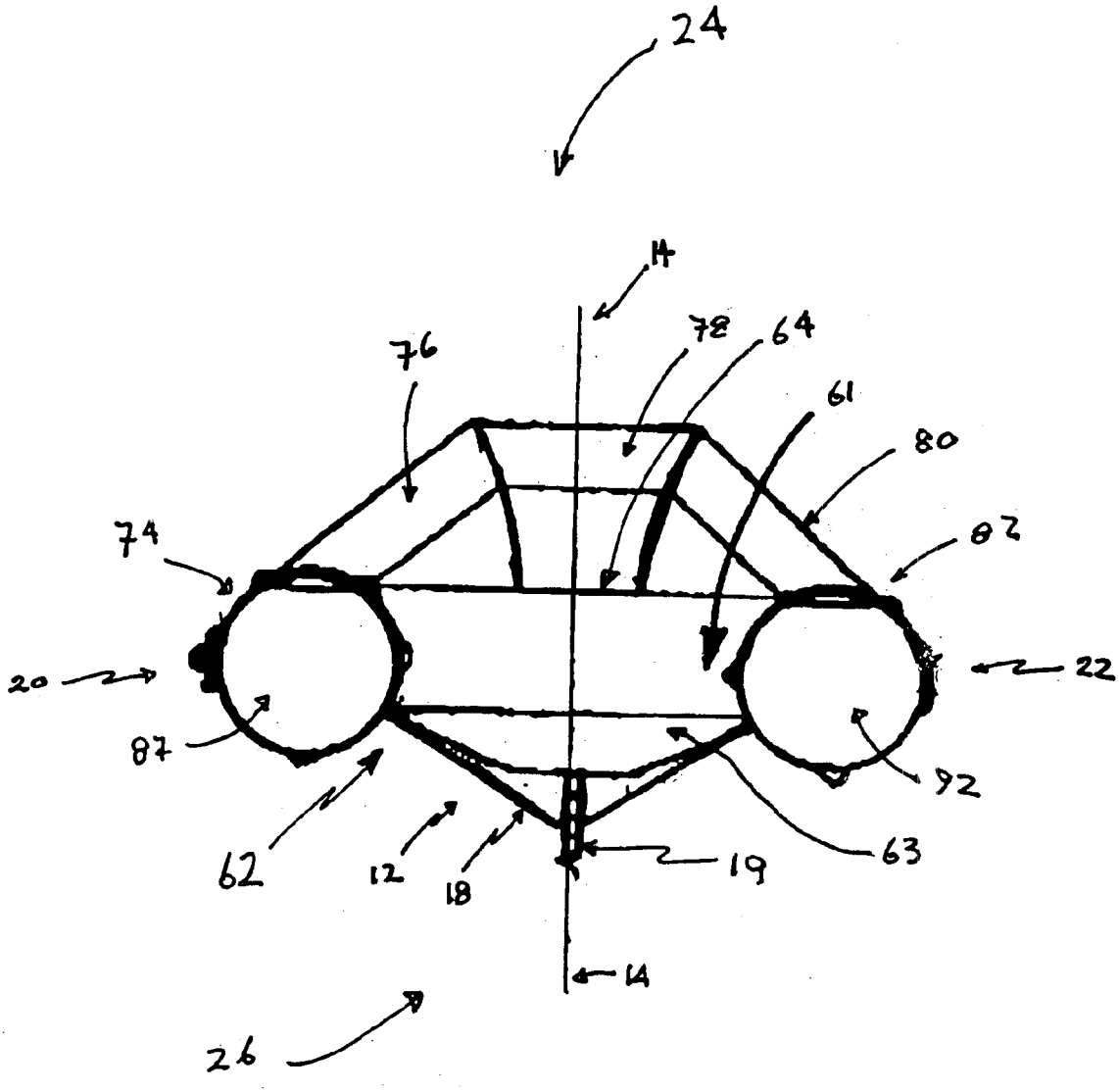
FIG. 6 is a stern-on view of one embodiment of the water craft of my invention.

Referring to FIG. 5 and FIG. 6, there is shown transom member (62) fixed to the stern (26) of the hull portion (12). The respective stern ends (87) and (92) of the first lengths of the port and starboard pontoon members extend beyond the transom member (62). The transom member has a first portion (61) and a second portion (63). The first portion (61) is fixed between and inside of the adjacent port and starboard first pontoon members (74) and (82) respectively. A second piece of aluminum is welded onto the top outside portion of the transom member to strengthen it so that an outboard motor can be fixed thereto. Second portion (63) of the transom member (62) conforms to the shape of the hull. The first portion (61) is adapted to accept a small outboard motor having a propeller and the second portion (63) of the transom is adapted to provide clearance between the propeller and the stern of the hull portion. The transom has an incline of about 5 degrees from the vertical and into the hull of the water craft.

Figure 7:
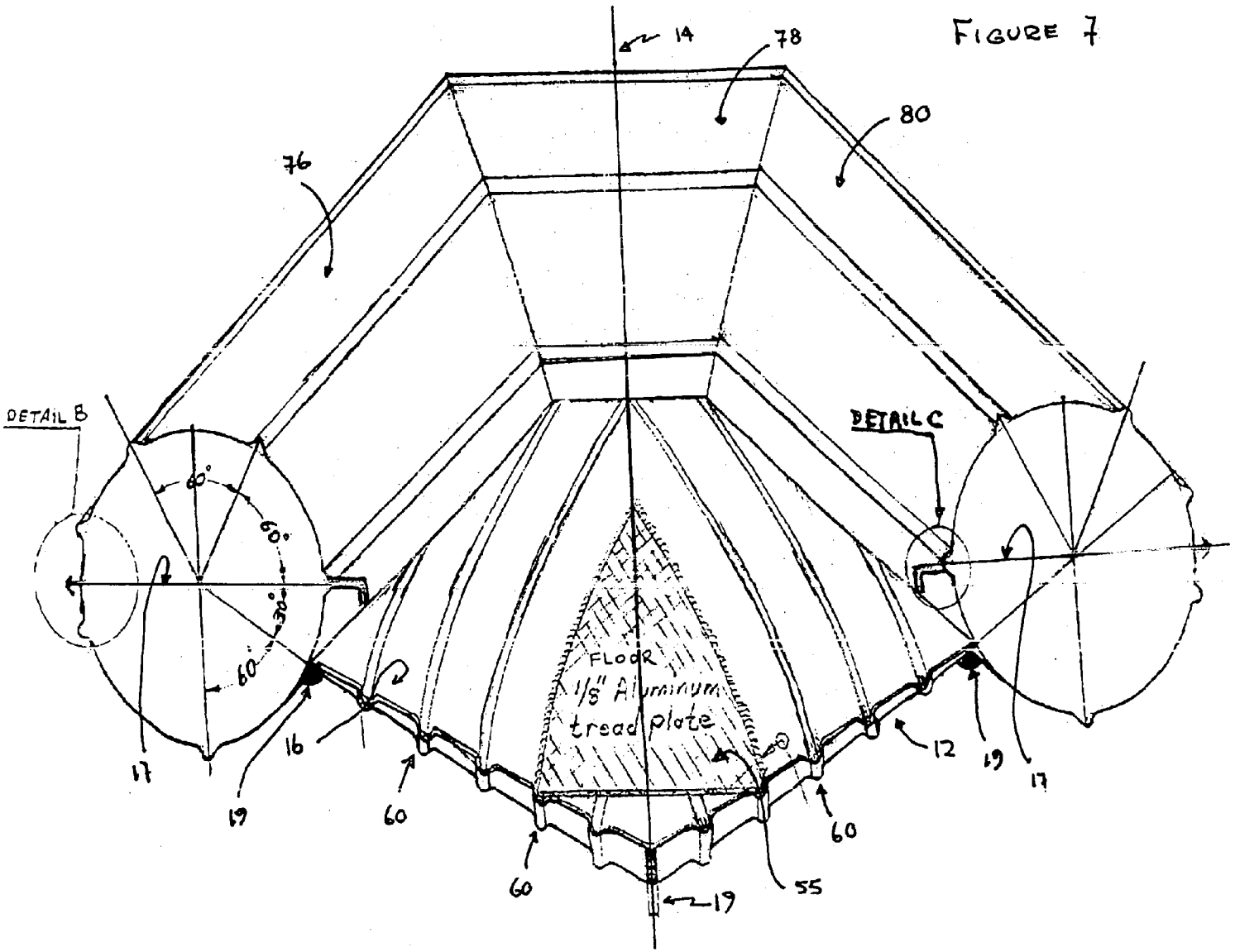
FIG. 7 is a cross-sectional view of the inclined bow portion of one embodiment of my invention.

Referring now to FIG. 7, there is a sectional view across the port second pontoon member (76) and the opposite starboard second pontoon member (80) with a section of hull portion (12) between them. Bow pontoon member (78) is also shown. This cross section illustrates the plurality downwards depending strengthening ribs (60) that are pressed into the top surface (16) of the hull portion (12) that are parallel and equally spaced therein. The ribs (60) are formed by pressing during the manufacturing process as more fully described below. While the ribs are initially equally spaced and parallel on the construction sheets, as the bow section is formed and inclined, the formation of the bow section will cause the ribs to converge at the bow as shown. A cross section of floor plate (55) is also shown comprising a one-eight inch thick aluminum tread plate. Also shown in FIG. 6 are the reinforcing ribs pressed into the pontoon members (80) and (82). The hull portion (12) is welded at (7) to the plurality of pontoon members at a point that is 30 degrees below the horizontal axis (17) of the pontoon members.

Figure 8:
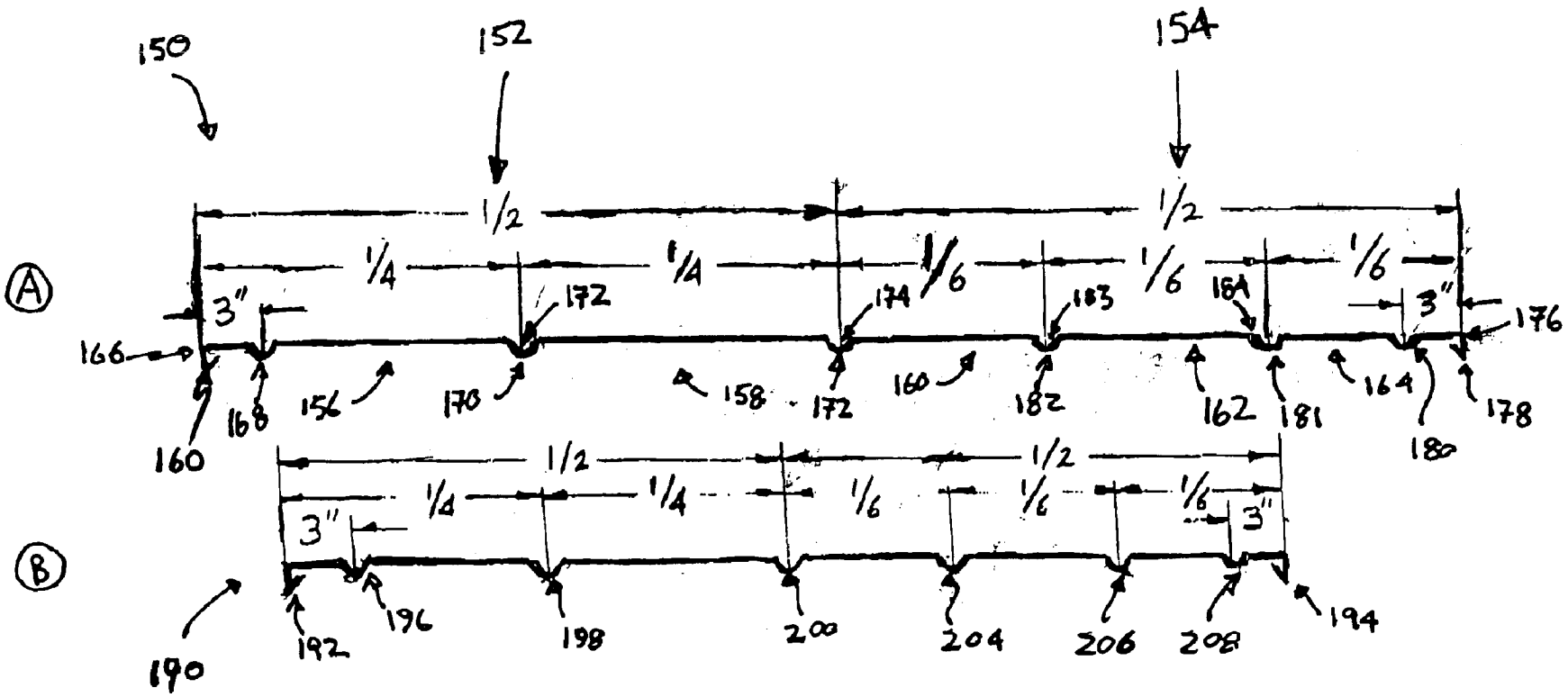
FIG. 8 is an elevation view of the sheets of aluminum construction material used to fabricate the pontoons of the water craft of my invention.

Referring to FIG. 8, there are shown the metal sheets from which the plurality of pontoon cylinders is fabricated for two embodiments of my invention. FIG. 8A shows the metal sheet (150) used for the pontoon cylinders of a 13 foot embodiment of the water craft and FIG. 8B shows the metal sheet (190) used for the 11 foot embodiment of the water craft. The sheets (150) and (190) are made from aluminum and are preferably and typically 0.063 inches thick but the thickness can vary depending on the needs of the purchaser or availability of the preferred material. For the 13 foot embodiment the sheet (150) is 60 inches wide and for the 11 foot embodiment the sheet (190) is 48 inches wide. The length of the respective sheets conforms to the desired length of the pontoon member being fabricated. FIG. 8A and FIG. 8B show the reinforcing ribs of the pontoon members that are pressed into the sheets. The spatial relationship of the features shown on sheets (150) and (190) are used for all other lengths of the water craft. Referring to FIG. 8A sheet (150) is bi-sectioned into a first half (152) and a second half (154) (for illustrative purposes only). First half (152) is further bi-sectioned into first quarter (156) and second quarter (158). The second half (154) is sectioned into thirds (160), (162) and (164). For the first half section (152) the first end (166) of the section (156) is formed with a flechette (160). Spaced inwards 3 inches from the flechette (160) is formed first rib (168). Second rib (170) is formed at the mid point (172) of the first half section (152). The third rib (172) is located at the mid point (174) of the sheet (150). Referring to the second end (176) of sheet (150) there is formed a second flechette (178). A fourth rib (180) is formed 3 inches center-ward from the second flechette (178). A fifth rib (181) is formed at the end (184) of the first third section (164) of the second half (154). A sixth rib (182) is formed at the end (183) of the second third section (162) of the second half (154). These reinforcing ribs provide remarkable strength to the pontoon member and permit a significant reduction in weight.

Referring to FIG. 8B and the sheet (190) used for the 11 foot embodiment of the water craft the flechettes (192) and (194) and the ribs (196), (198), (200), (202), (204), (206) and (208) are spaced using the same relationship as shown in FIG. 8A.

Figure 9:
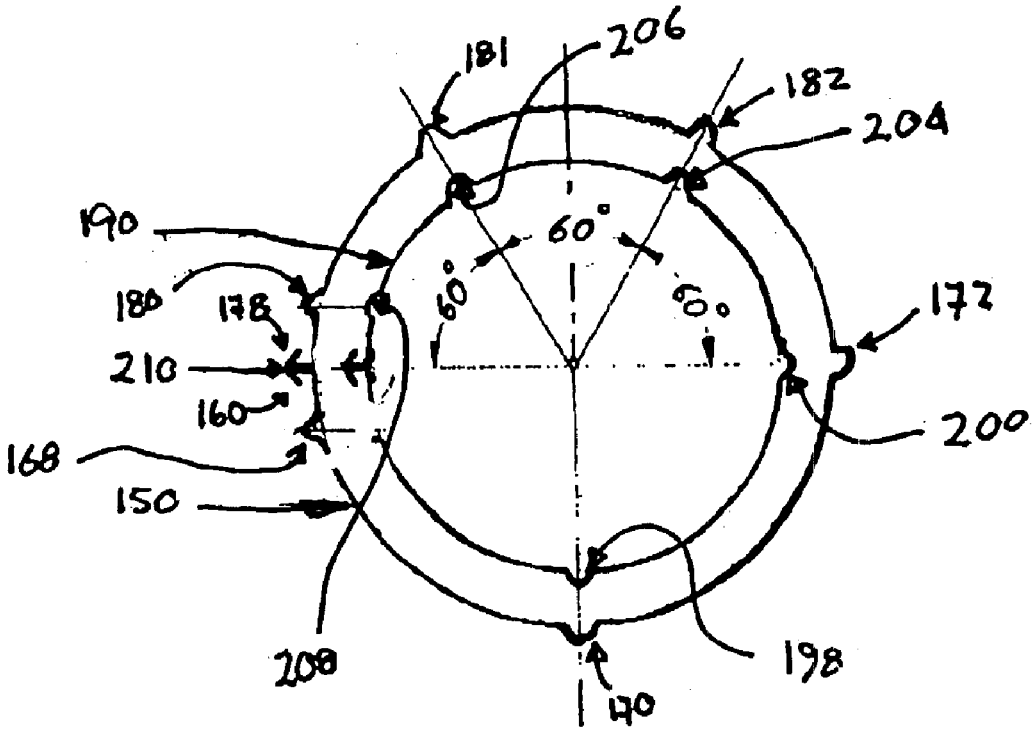
FIG. 9 is a cross-sectional view of the pontoons of two embodiments of the water craft of my invention shown in a concentric relationship to illustrate the congruity of the features between them.

Referring now to FIG. 9, which is an expanded view of "Detail B" on FIG. 7, there is shown sheets (150) and (190) rolled into their respective cylindrical pontoon members. Rolled sheet (190) is shown within rolled sheet (150) to show the spatial congruity between the two sheets. This diagram is not to suggest that the pontoons are double walled. The sheets are rolled into cylinders so that flechettes (178) and (160) for sheet (150) are adjacent and form arrow hook (210). The arrow hook is adapted to receive fender (130) which has a similarly configured cavity as shown later. Note that the angular separation between arrow hook (210) and ribs (181), (182) and (172) is 60 degrees each. The angular separation between arrow hook (210) and rib (170) and rib (172) is 90 degrees. Arrow hook (210) is located between ribs (180) and (168) because this area of the pontoon will be stressed by docking loads and therefore additional reinforcement is required. Similarly, ribs (181) and (182) are located on the top of the pontoon members because these surfaces also bear handles, oar locks and seating platforms and therefore require additional reinforcement. Each of the pontoon members are fixed on their cylindrical shapes at the top of the arrow hooks by continuous welding along joints (211).

Figure 10:
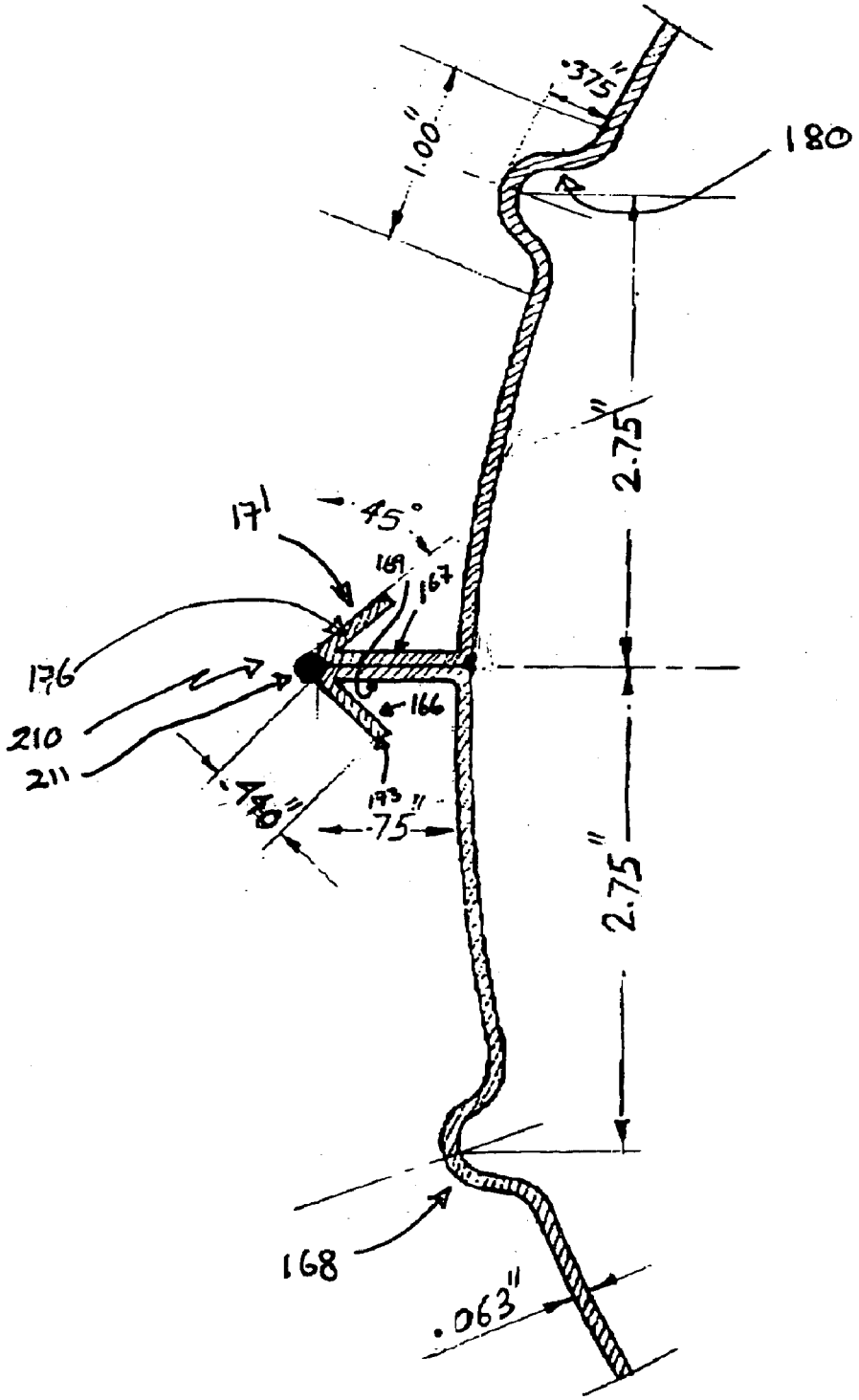
FIG. 10 is a detailed cross-sectional view of the area shown as Detail B in FIG. 7 of one embodiment of the water craft of my invention.

Now referring to FIG. 10, there is shown detail of the pontoon members about angle hook (210). Angle hook (210) is formed when flechette (166) and (176) are brought together during the rolling process explained below. The two ends of the construction sheets are welded together continuous along joint (211). The flechettes each have a stem (167) and (169) and barbs (171) and (173). The dimensions shown in FIG. 10 are typical of the 13 foot embodiment of the water craft of my invention. Understandably these dimensions may vary according to differing lengths of the water craft. The ribs (180) and (168) on all embodiments are 0.375 inches high and have a base of one inch. All other ribs are similarly dimensioned. The stems (167) and (169) of the flechettes (176) and (166) are 0.75 inches high and their depending barbs (171) and (173) depend at an angle of 45 degrees and have a length of 0.440 inches. The thickness of the aluminum construction material is 0.063 inches.

Figure 11:
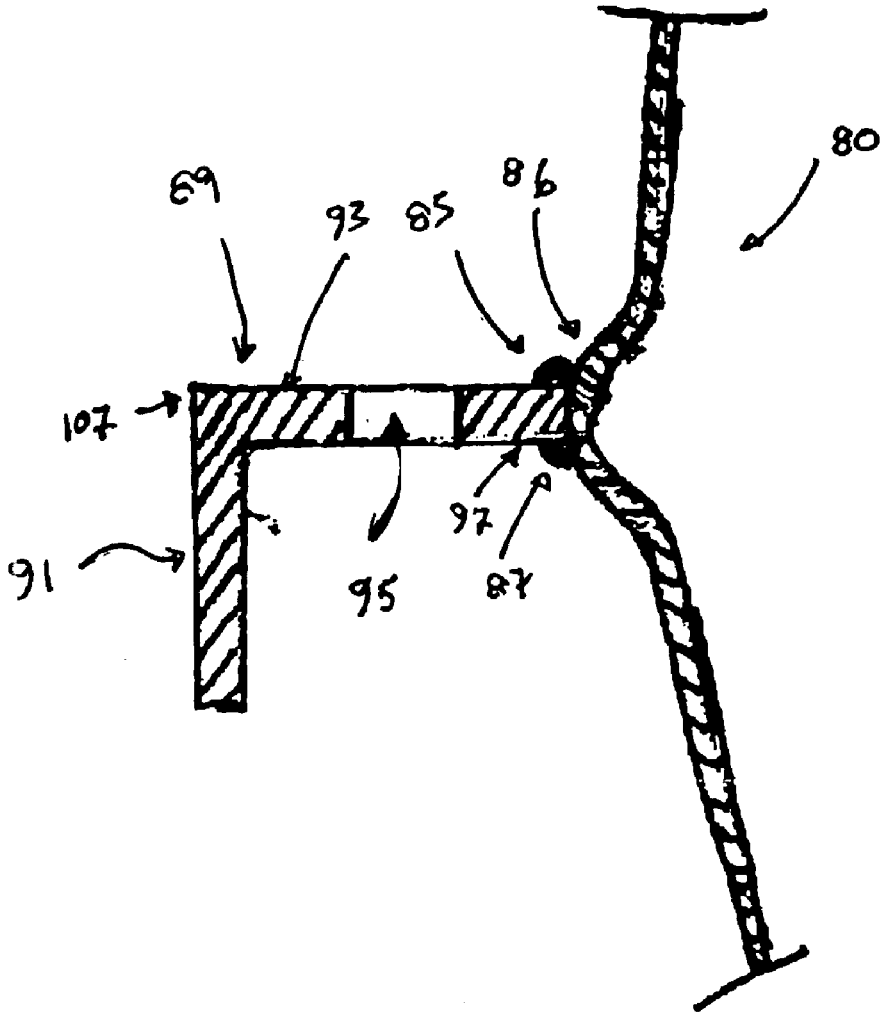
FIG. 11 is a detailed cross-sectional side view of Detail C in FIG. 7 and the angle member used to mount seats inside the hull portion of one embodiment of my invention.

Referring now to FIG. 11, there is shown in greater detail the portion of FIG. 7 annotated as "Detail C". Longitudinal aluminum angle member (89) is shown fixed by welding (85) and (87) continuously along the length of pontoon (80) and more specifically along reinforcing rib (81) pressed into pontoon (80). The angle is fixed to rib (81) as that point has additional strength. The Angle member (89) has a first horizontal portion (93) having a first end (97) that is welded to the rib (81). From the opposite end (107) of the horizontal portion (93) depends vertical portion (91). A parade of apertures (95) is located along the length of the angle member (89) to permit fixing of the seats inside of the small craft. A similar longitudinal angle member is welded to the inside surface of pontoon member (74).

Figure 12:
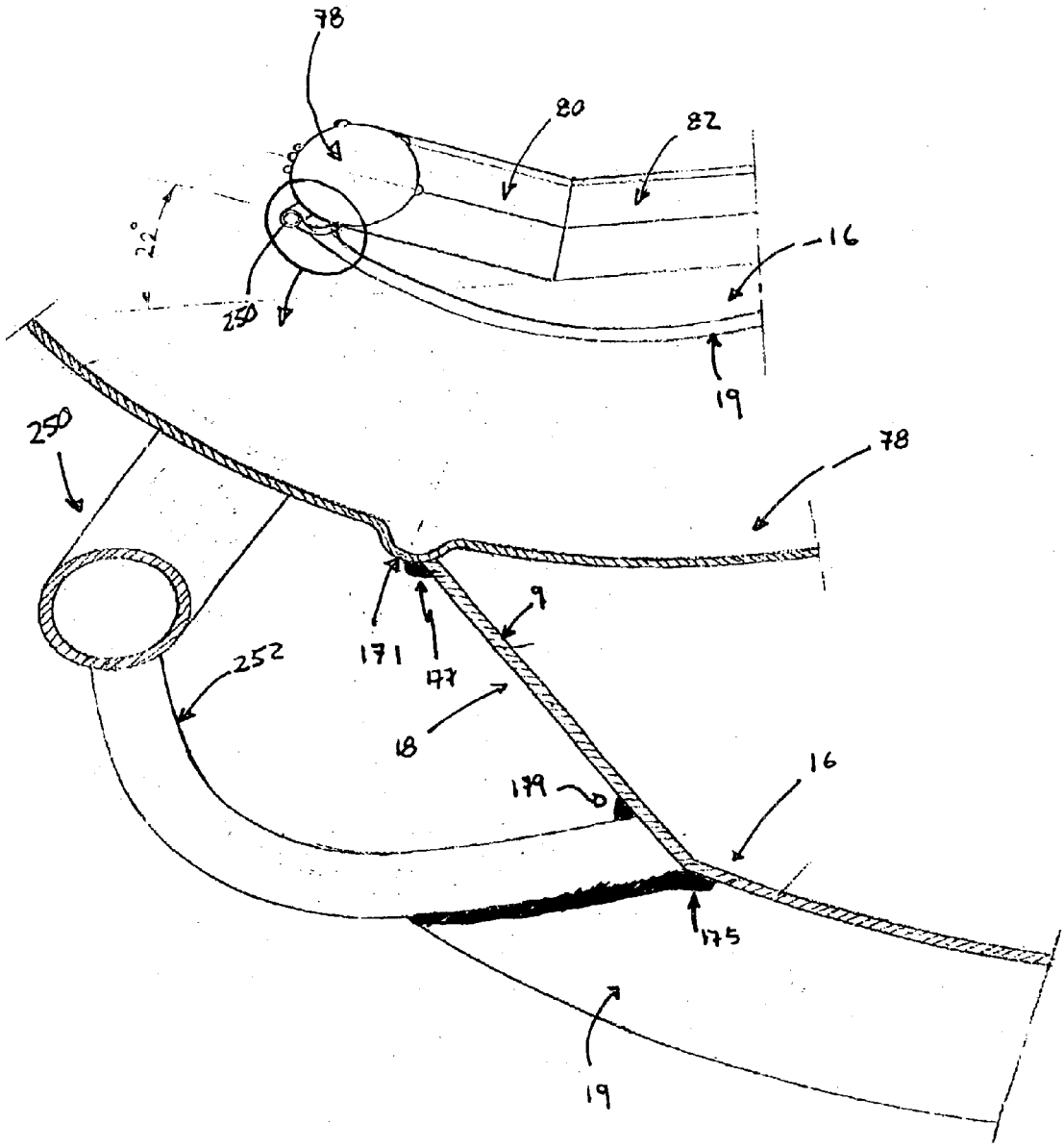
FIG. 12 is a detailed cross-sectional view of the bow pontoon of the water craft of my invention showing the connection between the bow pontoon member and the truncated hull portion.

Referring now to FIG. 12, there is shown details of how the truncated bow (9) is fixed to bow pontoon member (78). Reinforcing rib (171) is pressed into bow pontoon member (78) by pressing means. The rib locations correspond to the stronger portions of the pontoon member, the truncated bow (9) is welded to the bow pontoon member at that point by way of a weld (177). Also welded to the bow pontoon member (78) is handle (250) and tow ring (252). The tow ring (252) is welded by way of weld (175) to the keel member (19).

Figure 13:
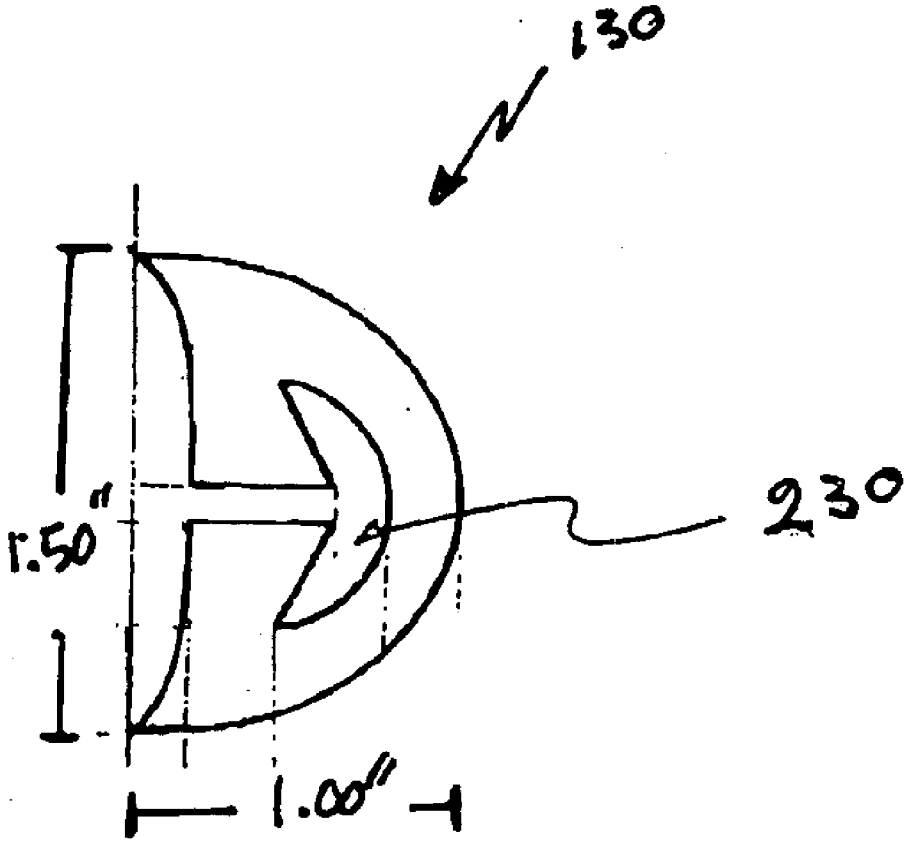
FIG. 13 is a cross-section view of the fender of one embodiment of the water craft of my invention.

Referring to FIG. 13 there is shown a cross section of fender (130) having a "D" shape and an internal cavity (230) that is shaped similarly to arrow hook (210) and adapted to receive arrow hook (210) in order to fix the fender to the outside of the plurality of pontoon members. The fender is made form a suitable material having desired properties of UV radiation resistance, resiliency and shock absorbency. Fender (130) has a width of 1 inch and a height of 1.5 inches.

Figure 14:
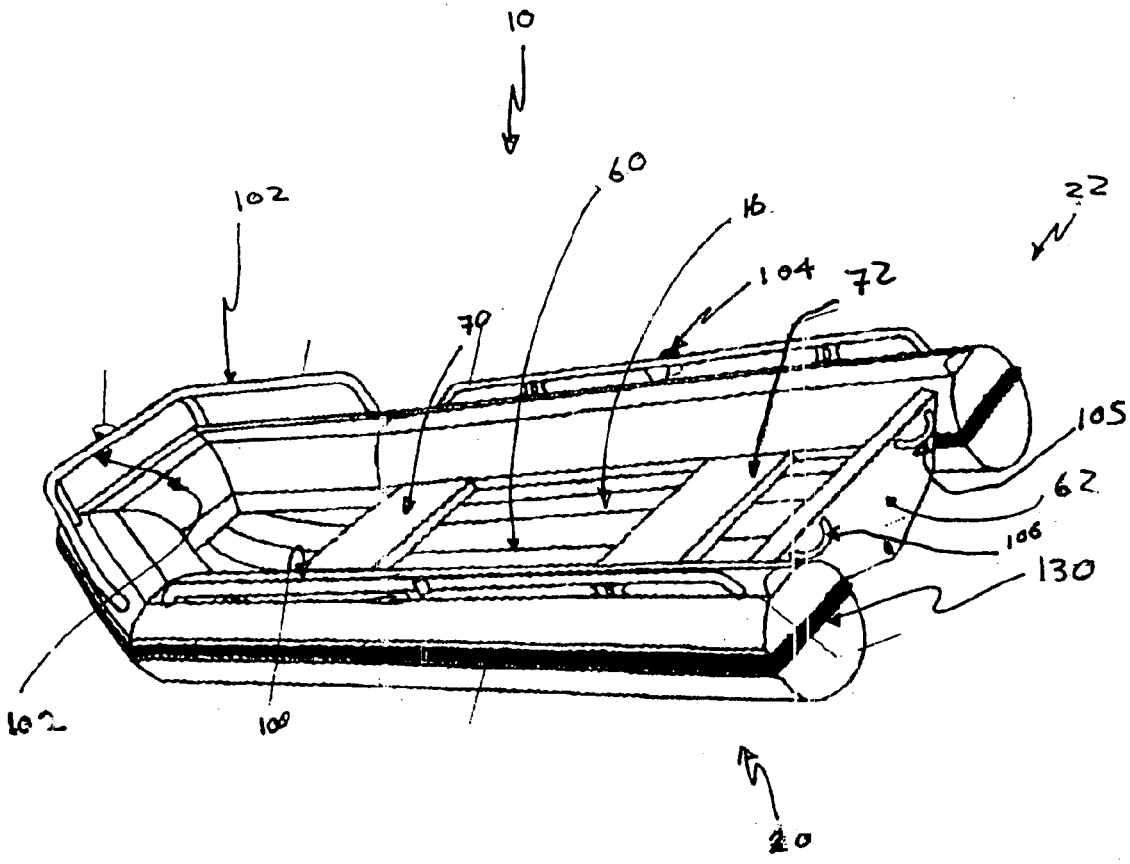
FIG. 14 one embodiment of my invention with seats and hand holds fixed to it.

FIG. 14 illustrates various pieces of equipment welded to the water craft such as hand holds (100), (102), and (104) and tow hook handles (105) and (106). Between the first port side (30) of the first horizontal section (15) and the first starboard side (42) of the first horizontal section (15) are disposed and fixed at least two flat members (70) and (72) adapted for use as seats for operators and passengers.

In another embodiment of the invention, the exposed surfaces of the construction material are covered with waterproof material such as vinyl or weather resistant paint.

In still another embodiment of the invention there may be included a small cockpit placed in the bow of the vessel to offer the operator a better view of the open water and to shelter the operator.

Figure 15:
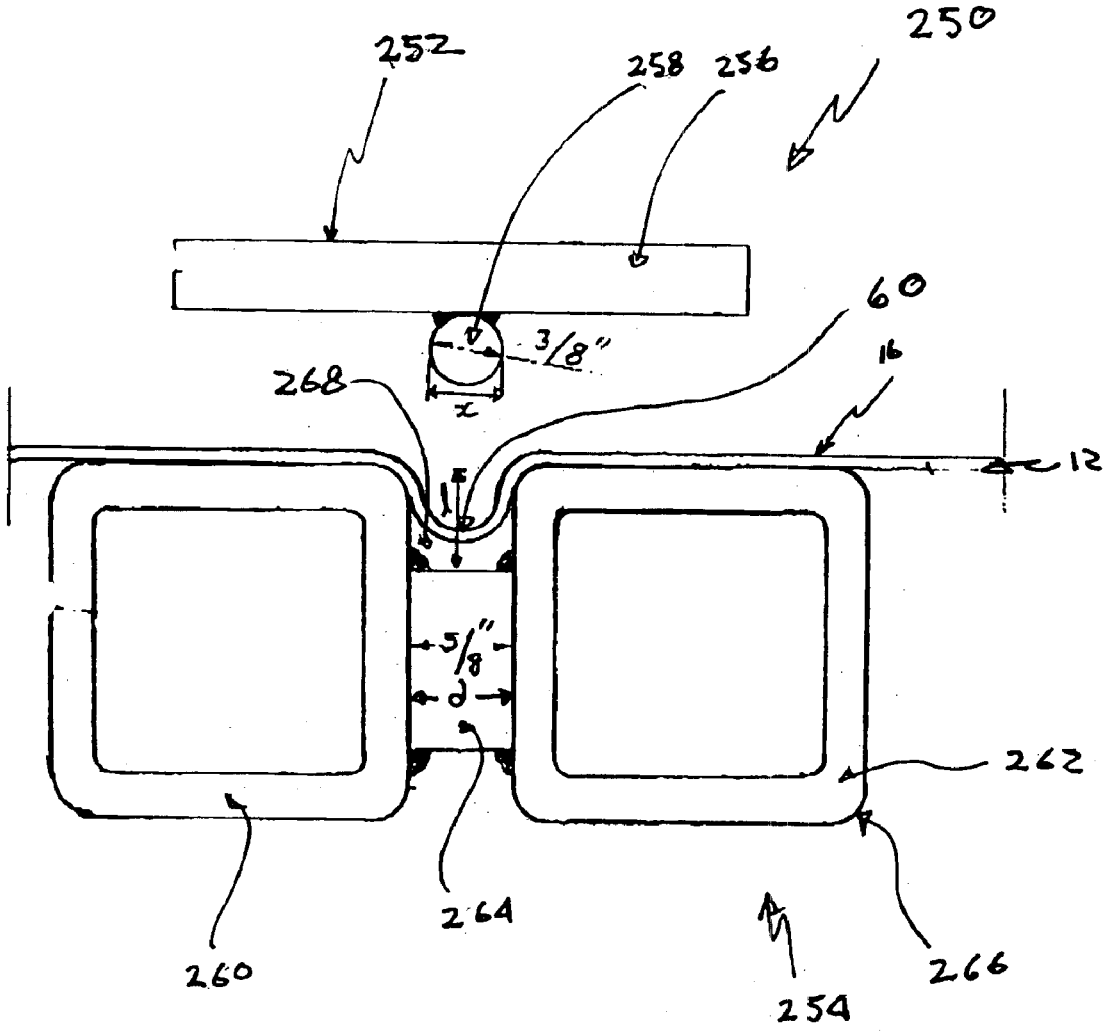
FIG. 15 shows one embodiment of the apparatus used to impart the reinforcing ribs into the construction material used in my invention.

FIG. 15 illustrates one embodiment of the apparatus (250) used to press the ribs (60) into the hull portion (12) and other the other ribs previously described that are pressed into the plurality of pontoon members. The apparatus (250) comprises a press that comprises a top die portion (252) and a bottom die portion (254). The top die portion (252) comprises a plate (256) to which is fastened a rod (258). Rod (258) is generally about ⅜ inches in diameter. The rod is used to press into the top surface (16) of the hull portion (12) the plurality of concave shaped ribs along the entire length of the hull portion (12). This is repeated at the desired equally spaced intervals as discussed above. The bottom die (254) comprises a first (260) and second (262) tubular frame members joined together by a spacing member (264). The spacing member is about ⅝ inches long and separates the tubular frame members by that amount. This gives the ribs a base of about 1 inch. The tubular frame members have rounded edges (266) so provide for a smooth surface to the raised rib in the aluminum member. The distance (d) between the tubular frame members and the depth (l) of the lower die cavity (268) are agreeable with the diameter (x) of the upper die rod (258) so that the entire diameter of the upper die rod plus the thickness of the construction material is accommodated in the cavity (268). Hence, when the upper die is pressed into the lower die, the sheet between them is plastically deformed into a concave trench thereby forming the reinforcing rib.

Figure 16:
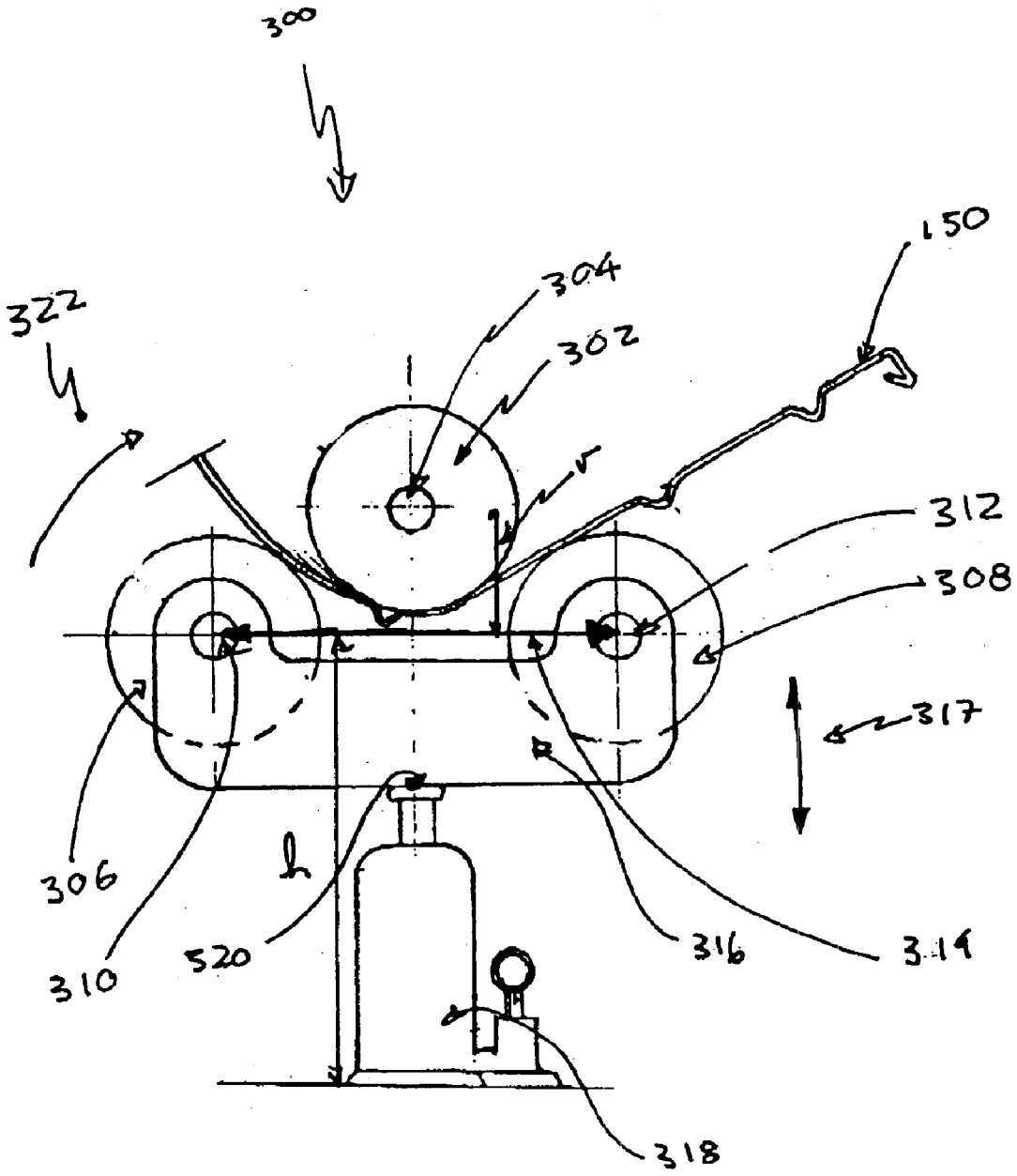
FIG. 16 is an illustration of the apparatus of one embodiment of my invention used to roll the sheets used to fabricate the pontoons of my invention.

FIG. 16 illustrates one embodiment of the rolling apparatus (300) used to form the plurality of cylindrical pontoon members. FIG. 16 illustrates the rolling of sheet (150) for illustration purposes only. The rolling apparatus comprises an upper fixed single roller (302) mounted on a single axis (304) positioned above lower first (306) and second (308) adjacent rollers mounted on respective axes (310) and (312). The axes (304), (310) and (312) are all parallel to each other. Axes (310) and (312) are spaced apart and adjacent to each other. They are both at height (h). The lateral distance (l) at (314) between the two lower rollers is adjustable using adjusting means. The lateral distance (l) between the two lower roller axis is sufficient to accommodate the diameter of the upper roller and, as well, to create the desired pontoon diameter. The lower parallel rollers are mounted on a frame member (316) and are capable of upwards and downwards movement (317) by a jacking mechanism (318) towards and away from the upper fixed roller (302). By permitting an upwards and downwards movement of the two lower rollers with respect to the stationary top roller the desirable diameter of the pontoon can be set. For example, to manufacture of pontoon having a smaller diameter the vertical distance (v) between the parallel axes of the lower rollers and the parallel axis of the fixed upper roller is decreased. To increase the diameter of the pontoon the vertical distance (v) between the axes is increased.

The frame member (316) is pivotally mounted at pivot point (320) at its lower mid point to jacking mechanism (318). In the embodiment shown the raising and lowering device is a manually operated bottle jack but other embodiments of the invention contemplate other hydraulic or electric raising and lower means that will produce the desired results. The pivot mount (320) is adapted to permit pivoting movement of the frame (316) so that each one of the parallel lower rollers can be pressed alternatively towards the upper fixed roller as illustrated by arrow (322). The ability to pivot the frame member permits the previously formed reinforcing ribs to pass across the lower rollers without damage.

A method of manufacturing the water craft of the 11 and 13 foot embodiments includes the steps of:

Forming the hull of the water craft by:

First obtaining a single rectangular sheet of aluminum construction material;

Pressing into the sheet a plurality of spaced parallel reinforcing ribs along their entire length wherein the ribs having a predetermined spacing and vertical depth;

Bending the sheet to form the to form the hull of the craft having an inclined bow portion;

Installing a keel on to the axis of the hull by welding additional aluminum strip continually along the longitudinal axis of the craft;

Forming a plurality of cylindrical pontoon members by:

Obtaining a plurality of rectangular sheets of aluminum construction material;

Forming into the opposite ends of the construction material a first and second flechette;

Pressing into the sheets a plurality of parallel ribs along their entire length a predetermined intervals;

Rolling the sheets into cylinders so that the flechettes are adjacent to each other thereby forming arrow hooks;

Welding the cylinders ends together along their joints to form a truncated "U" shaped collar;

Welding the pontoon members to the hull;

Welding the transom member to the hull; and,

Welding ancillary equipment such as hand holds and hooks to the hull and pontoon members.

Although this description has much specificity, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A pontoon stabilized aluminum water craft comprising:

a. a truncated "U" shaped hull portion having a longitudinal axis, a length, a top surface, and a bottom surface, said hull portion comprising:

i. a first rectangular sheet of aluminum having a top surface and a bottom surface;

ii. a first horizontal section having a first port side, a first starboard side and a stern;

iii. a second bow section contiguous to said first horizontal section, said second bow section having a first positive acclivity, a second port side, a second starboard side and a bow;

iv. a plurality of parallel and equally spaced apart concave-shaped reinforcing ribs pressed by pressing means into said top surface of said first rectangular sheet of aluminum;

b. a keel member fixed by fixing means to said bottom surface of the hull portion along said longitudinal axis; and, c. a plurality of cylindrical pontoon members fixed by fixing means to the hull portion wherein said plurality of cylindrical pontoon members are adapted to provide buoyancy and stability to said water craft.

2. The water craft as claimed in claim 1, wherein said fixing means comprises a welding process suitable for welding aluminum.

3. The water craft as claimed in claim 1, wherein the hull portion is fabricated from at least two rectangular sheets of aluminum fixed together by fixing means along said keel.

4. The water craft as claimed in claim 1, wherein said plurality of cylindrical pontoon members comprises:

a. a first port side pontoon member having a stern end and a bow end, wherein said first port side pontoon member is fixed by fixing means to said first port side of the hull portion first horizontal section;

b. a first starboard side pontoon member having a stern end and a bow end, wherein said first starboard side pontoon member is fixed by fixing means to said first starboard side of the hull portion first horizontal section;

c. a second port side pontoon member having a stern end and a bow end, wherein said second port side pontoon member is fixed by fixing means to said second port side of said second bow section;

d. a second starboard pontoon member having a stern end and a bow end, wherein said second starboard member is fixed by fixing means to said second starboard side of the second bow section; and, e. a bow pontoon member having a port end and a starboard end, wherein said bow pontoon member is oriented across said bow and perpendicular to the longitudinal axis of the hull portion.

5. The water craft as claimed in claim 4, wherein the plurality of cylindrical pontoon members are fixed together, wherein:

a. said second port side pontoon member stern end is fixed by fixing means to said first port side pontoon member bow end, and wherein a bulkhead plate is fixed by fixing means between the second port side pontoon member stern end and the first port side pontoon member bow end;

b. said second starboard side pontoon member stern end is fixed by fixing means to said first starboard side pontoon member bow end, and wherein a bulkhead plate is fixed by fixing means between the second starboard side pontoon member and the first starboard side pontoon member bow end, c. said port end of said bow pontoon member is fixed by fixing means to said bow end of said second port side pontoon member, and wherein a bulkhead plate is fixed by fixing means between the port end of the bow pontoon member and the bow end of the second port side pontoon member; and, d. said starboard end of the bow pontoon member is fixed by fixing means to said bow end of the second starboard side pontoon member, and wherein a bulkhead plate is fixed by fixing means between the starboard end of the bow pontoon member and the bow end of the second starboard side pontoon member.

6. The water craft as claimed in claim 5, wherein said stern end of the first starboard side pontoon member is sealed by a domed cap bulkhead plate fixed by fixing means to the stern end of the first starboard side pontoon member by fixing means, and further wherein said stern end of the first port side pontoon member is sealed by a domed cap bulkhead plate fixed by fixing means to the stern end of the first port side pontoon member.

7. The water craft as claimed in claim 6 wherein said plurality of pontoon members fixed together form a truncated "U"-shaped floatation collar, said collar being segmented, un-pressurized, water-tight and air filled.

8. The water craft as claimed in claim 7, wherein said flotation collar is fixed by fixing means to the hull portion of the water craft thereby providing for enhanced buoyancy and stability to the water craft.

9. The water craft as claimed in claim 8, wherein the water craft further includes a transom member fixed to the stern of the hull portion by fixing means.

10. The water craft as claimed in claim 9, wherein the first port side pontoon member has a first longitudinal axis, and wherein the first starboard side pontoon member has a second longitudinal axis, and wherein said first longitudinal axis and said second longitudinal axis are parallel and co-planer, and wherein the first longitudinal axis and the second longitudinal axis posses a second positive acclivity from the horizontal so that the first port side pontoon member and the first starboard side pontoon member are slightly positively inclined from their respective stern ends to their respective bow ends, and wherein said second acclivity is adapted to promote smooth splash-free passage of the water craft over water.

11. The water craft as claimed in claim 10, wherein the second port side pontoon member has a third longitudinal axis, and wherein the second starboard side pontoon member has a fourth longitudinal axis, and wherein said third longitudinal axis is parallel to and co-planer with said fourth longitudinal axis, and wherein the third longitudinal axis and the fourth longitudinal axis have a third positively acclivity with respect to the horizontal, and wherein said third positive acclivity is greater than the second positive acclivity but less than the first positive acclivity so that the bow pontoon member does not obscure the forward vision of the water craft operator.

12. The water craft as claimed in claim 11, wherein each of the cylindrical pontoon members of the plurality of cylindrical pontoon members are fabricated from a second rectangular sheet of aluminum, said second sheet having:

a. a predetermined width and a predetermined length, said predetermined length and said predetermined width being proportional to said length of the hull portion;

b. a first side having said predetermined width;

c. a second side having the predetermined width, said second side opposite said first side;

d. a third side having said predetermined length;

e. a fourth side having the predetermined length, said fourth side opposite said third side;

f. a top surface; and, g. a bottom surface.

13. The water craft as claimed in claim 12 wherein a plurality of structural features are added to the second sheet, said structural features comprising:

a. a first flechette formed along said first side by bending the first side into said first flechette, wherein the first flechette has a first stem and a first barb;

b. a second flechette formed along said second side by bending the second side into said second flechette, said second flechette having a second stem and a second barb, wherein said second barb is facing away from said first barb;

c. a first reinforcing rib pressed by pressing means along the predetermined width of the sheet and into said top surface of the sheet, said first reinforcing rib located adjacent to said first flechette;

d. a second reinforcing rib pressed by pressing means into the top surface of the sheet, said second reinforcing rib parallel to the first reinforcing rib, wherein the second reinforcing rib located adjacent to said second flechette;

e. a third reinforcing rib pressed by pressing means into the top surface of the sheet, said third reinforcing rib parallel to the first and the second reinforcing ribs, wherein the third reinforcing rib is positioned midway between the first side and the second side;

f. a fourth reinforcing rib pressed by pressing means into the top surface of the sheet, said fourth reinforcing rib parallel to the first, second and third reinforcing ribs, the fourth reinforcing rib positioned midway between the third reinforcing rib and the first flechette;

g. a fifth reinforcing rib pressed by pressing means into the top surface of the sheet, said fifth reinforcing rib parallel to the first, second, third, and fourth reinforcing ribs, the fifth reinforcing rib located at a point that is one third the distance between said mid point and said second flechette; and, h. a sixth reinforcing rib pressed by pressing means within the top surface of the sheet, said sixth reinforcing rib parallel to the first, second, third, fourth and fifth reinforcing rib, the sixth reinforcing rib located at a point two thirds the distance between said mid point and said second flechette.

14. The water craft as claimed in claim 13 wherein subsequent to the formation of the structural features, the second sheet is rolled by rolling means into a cylinder such that the first flechette and the second flechette are adjacent to each other and fixed together by fixing means, and such that the first barb and the second barb form an arrow-shaped hook adapted for receiving said fender, and such that the top surface of the sheet becomes the inside surface of the cylinder and the bottom surface of the sheet becomes the outside surface of the cylinder.

15. The water craft as claimed in claim 14, wherein said pressing means comprises a press comprising:

a. a top die portion comprising a plate and a rod fastened to said plate, wherein said rod is used to press the plurality of parallel and equally spaced apart concave-shaped reinforcing ribs into the top surface of the first and second sheets of aluminum; and, b. a bottom die portion comprising a first and second tubular frame members joined together by a spacing member, said first and second tubular frame members having rounded edges so as to provide a smooth surface to the plurality of ribs.

16. The water craft as claimed in claim 15 wherein said rolling means comprises a. an upper fixed single roller mounted on a single first axis positioned above;

b. a lower first and second adjacent rollers mounted on second and third axis, wherein said first, second and third axis are parallel and spaced apart by an adjustable distance (d), and wherein the first axis is spaced apart from the second and third axis by an adjustable distance (v) distance so that the diameter of the plurality of cylindrical pontoon members can be adjusted.

* * * * *